US007071932B2

(12) United States Patent
Libsch et al.

(10) Patent No.: US 7,071,932 B2
(45) Date of Patent: Jul. 4, 2006

(54) DATA VOLTAGE CURRENT DRIVE AMOLED PIXEL CIRCUIT

(75) Inventors: Frank R Libsch, White Plains, NY (US); James L Sanford, Hopewell Junction, NY (US)

(73) Assignee: Toppoly Optoelectronics Corporation (TW)

( * ) Notice: Subject to any disclaimer, the term of this patent is extended or adjusted under 35 U.S.C. 154(b) by 291 days.

(21) Appl. No.: 10/287,937

(22) Filed: Nov. 5, 2002

(65) Prior Publication Data

US 2003/0095087 A1 May 22, 2003

Related U.S. Application Data

(60) Provisional application No. 60/331,913, filed on Nov. 20, 2001.

(51) Int. Cl.
*G09G 5/00* (2006.01)

(52) U.S. Cl. ..... 345/211; 345/82

(58) Field of Classification Search ..... 345/82, 345/84, 204, 211–213; 315/169.3
See application file for complete search history.

(56) References Cited

U.S. PATENT DOCUMENTS 5,952,789 A * 9/1999 Stewart et al. ..... 315/169.4
6,023,259 A * 2/2000 Howard et al. ..... 345/76
6,157,356 A * 12/2000 Troutman ..... 345/82
6,479,940 B1 * 11/2002 Ishizuka ..... 315/169.3
6,518,962 B1 * 2/2003 Kimura et al. ..... 345/211
6,552,703 B1 * 4/2003 Ushigusa ..... 345/77
6,710,548 B1 * 3/2004 Kimura ..... 315/169.3
6,809,710 B1 * 10/2004 Prache et al. ..... 345/82
6,859,193 B1 * 2/2005 Yumoto ..... 345/82
6,861,810 B1 * 3/2005 Rutherford ..... 315/169.3
6,864,637 B1 * 3/2005 Park et al. ..... 315/169.1
6,885,356 B1 * 4/2005 Hashimoto ..... 345/77
2001/0043173 A1 * 11/2001 Troutman ..... 345/82

OTHER PUBLICATIONS

Ton von de Biggelaar et al., "*Passive and Active Matrix Addressed Polymer Light Emitting Diode Displays*", vol. 4295, p. 134-146, Proc. SPIE, 2001.

M. Mizukami et al., "*36.1:6-Bit Digtial VGA OLED*", p. 912-915, SID 00 Digest, 2000.

T. Sasaoka et al. "*24.4L: Late-News Paper: A 13.0-inch AM-OLED Display with Top Emitting Structure and Adaptive Current Mode Programmed Pixel Circuit (TAC)*", p. 384-387, SID 00 Digest, 2001.

R. M. A. Dawson et al. "*The Impact of the Transient Response of Organic Light Emmitting Diodes on the Design of Active Matrix OLED Displays*", 32.6.1-32.6.4, IEEE, 1998.

(Continued)

*Primary Examiner*—Amr A. Awad
*Assistant Examiner*—Tom Sheng
(74) *Attorney, Agent, or Firm*—Ohlandt, Greeley, Ruggiero & Perle, L.L.C.

(57) ABSTRACT

There is provided a circuit for driving an organic light emitting diode (OLED). The circuit includes a current source for providing current to a first terminal of the OLED, and a generator for providing a variable voltage signal to a second terminal of the OLED to facilitate control of the current.

16 Claims, 4 Drawing Sheets

OTHER PUBLICATIONS

Ye He et al., "*Electrical Reliability of Two- and Four- a-Si:H TFT Pixel Electrode Circuits for Active-Matrix OLEDs*", p. 354-357, SID, 2000.

R. M. A. Dawson, "*Design of an Improved Pixel for Polysilicon Active-Matrix Organic LED Display*", p. 11-14, SID 98 Digest, 1998.

G. Gu and Stephen R. Forrest, "*Design of Flat-Panel Displays Based on Organic Light-Emitting Devices*", IEEE Journal of Selected Topics in Quantum Electronics, vol. 4, No. 1, Jan./Feb. 1998.

* cited by examiner

DATA VOLTAGE CURRENT DRIVE AMOLED PIXEL CIRCUIT

CROSS REFERENCE TO RELATED APPLICATIONS

The present application is claiming priority of U.S. Provisional Patent Application Ser. No. 60/331,913, filed on Nov. 20, 2001.

BACKGROUND OF THE INVENTION

1. Field of the Invention

The present invention relates to a pixel circuit, and more particularly, to a data voltage current-drive OLED pixel circuit. The circuit establishes a threshold voltage of a current drive transistor operating in saturation across a storage capacitor. Thereafter, the circuit writes a data voltage into the storage capacitor for controlling current through the OLED.

2. Description of the Prior Art

One method to achieve large size OLED (organic light emitting diode) displays is to use an active matrix thin film transistor (TFT) backplane. An active matrix consists of an array of rows and columns of pixels each having an active device such as a transistor. Row lines driven by row drivers are sequentially selected, one row line at a time, from top to bottom, while data for a selected row is presented on data lines or column lines by data or column drivers. The selected row turns on a pixel transistor that connects the data, typically in the form of a voltage, to a pixel circuit. The row lines are connected to gates of the pixel transistors and are often referred to as gatelines. Typically, pixel storage capacitors are used to store the data voltage. Leakage currents require that the pixel voltages be refreshed or updated. The refresh or frame rate for driving OLEDs is typically 60 Hz. The maximum time available for writing data into each row is tf/n where tf is frame time and n is the number of rows in the display.

Some manufacturers are using amorphous silicon (a-si), as opposed to polysilicon (p-si), to make active matrix OLED displays. In order to achieve sufficient luminance uniformity, OLED pixels are driven with current and not voltage. Amorphous silicon does not have complimentary devices as do polysilicon or crystalline silicon devices. Only n-type field effect transistors (NFETs) are available in amorphous silicon. Due to the manner in which the OLEDs are usually fabricated, i.e., having a common cathode for all pixels in the display, it is not normally possible to drive the OLEDs with a current source comprised of NFETs.

In typical active matrix addressing, voltage signals are written into each pixel to control the pixel luminance. The mobility and stability of amorphous silicon is suitable for driving twisted nematic liquid crystal, which is electrically similar to a small capacitive load and with which a data voltage is applied with a duty cycle in the range of 0.001% to 1%. However, for driving OLEDs requiring nearly continuous current for operation, the amorphous silicon operating voltages are non-zero for a substantially larger percentage of the time (duty cycles up to 100%). The higher voltage-time multiplier severely stresses the TFT. In particular, a gate to source voltage stress causes a threshold voltage to vary due to trapped charge at a semiconductor (a-si or p-si) gate insulator interface or in the gate insulator, and other effects such as creation of defect states and molecular bond breakage at the gate insulator-to-semiconductor interface and in a semiconductor layer. As the TFT's threshold voltage varies, current though the TFT will varies. As the current varies so does the OLED brightness since the OLED light output is proportional to current. A typical human observer can detect a pixel to pixel light output variation of as little as 1%, however, a level of 5% luminance variation is typically considered as being unacceptable. AC voltages on TFT terminals tend to minimize effects of trapped charge and can prolong TFT lifetimes.

IBM Corporation, the assignee of the present application, has considered a-Si TFT OLED current drive pixel circuit having three transistor pixel circuits that use current to write the pixel OLED current. The pixel circuits eliminated any dependence of threshold voltage on the OLED current. The pixel current can sink or source current to the OLED.

Since current is either sourced into or sunk out of the data or column line, the pixel circuits previously disclosed may not be suitable for high format displays. As the display format increases, the number of rows increase, thus increasing column line capacitance. To obtain a wide range of grey levels, the pixel current will need to vary between two and three orders of magnitude. The lower pixel currents may not be able to charge the column line in a line time due to the large capacitance. Higher level currents can be written and for a given luminance the OLED 'on' time can be reduced proportionately. However, the higher currents require higher voltage, and thus cause higher stress on the TFT. The higher currents also increase power supply voltage drops and current return voltage drops. At some point with increasing display format, this approach may not be practical. In addition, current source or sink drivers for active matrix organic light emitting diodes (AMOLEDs) are not presently commercially available.

A problem is that although voltage data drivers are readily available, there are no amorphous silicon pixel circuits that can convert the voltage data to current for driving an OLED having a common cathode, without a threshold voltage dependence.

Prior inventors, for example, see U.S. Pat. No. 5,552,678 to Tang et al., have attempted to solve problems of OLED degradation. When a constant voltage is applied, progressively lower current densities result. Lower current densities result in lower levels of light output with a constant applied voltage. Tang et al. incorporates an AC drive scheme of OLEDs, and claims that by applying an alternating voltage across the anode and cathode improves the stability and operating performance of the OLED.

A threshold voltage compensated current source pixel circuit using voltage data and polysilicon PMOS transistors has been described by R. M. A. Dawson et al., "The Impact of the Transient Response of Organic Light Emitting Diodes on the Design of Active Matrix OLED Displays", IEDM, p 875–878, 1998. The circuit incorporates 4 PMOS transistors and two storage capacitors. The circuit requires custom designed row drivers and the circuit does not appear to be suited for high-resolution displays.

A current writing amorphous silicon pixel circuit has been described by Yi He, et al., "Current Source a-Si:H Thin-Film Transistor Circuit for Active Matrix Organic Light-Emitting Displays", IEEE Electron Device Letters, Vol. 21, No. 12, p 590–592, December 2000. The circuit incorporates four transistors and a storage capacitor. The circuit requires custom design current data line drivers and the circuit dissipates a substantial amount of power as it incorporates two transistors in series to source current.

SUMMARY OF THE INVENTION

The present invention provides a circuit for driving a pixel of an active matrix OLED display. The circuit is implemented with relatively few TFTs, a minimal number of capacitors, and a minimal number of control lines. Such a circuit (1) minimizes an initial TFT threshold voltage shift, especially in a current drive TFT, (2) minimizes stress effects of the TFTs, especially the current drive TFT, that result in a time dependent threshold voltage shift, (3) has a data voltage write to the pixel, and (4) has a threshold voltage-independent voltage-to-current conversion, followed by pixel illumination.

The circuit is compatible with voltage amplitude modulated data drivers and pulse width modulated drivers. Another aspect of the circuit is that it reverses or provides AC voltages on TFT terminals to prolong TFT operation. An additional aspect of the present invention is that it provides an OLED architecture that facilitates a reverse bias of a scanned OLED array. Since OLEDs are thin film devices, charge can build up when driven normally in a forward bias manner. Reversing the voltage across the OLED removes built up charge and helps to maintain low voltage operation.

An embodiment of the present invention is a circuit for driving an OLED. The circuit includes a current source for providing current to a first terminal of the OLED, and a generator for providing a variable voltage signal to a second terminal of the OLED to facilitate control of the current.

Another embodiment of the present invention is a circuit for driving an OLED, where the circuit includes (a) a current drive transistor for providing current to a first terminal of the OLED, (b) a capacitor for storing a preset voltage and a data voltage, to control the current drive transistor, wherein the capacitor is connected to the first terminal, (c) a data transistor for adding the data voltage onto the capacitor, and (d) a generator for providing a variable voltage signal to a second terminal of the OLED to facilitate the control of the current drive transistor.

Because of the OLED impedance characteristics, prior art active matrix OLED pixel circuits, which store data in a capacitance, attempt to isolate the data storage capacitance from the OLED. In addition, no previous pixel circuit or driving methods apply a multilevel voltage signal to a terminal of an OLED.

DESCRIPTION OF THE INVENTION

An embodiment of the present invention is a circuit for driving an OLED. In a frame time, there is a preset time interval, a write data time interval and an expose time interval. During the preset time interval, the circuit sets a preset voltage on a storage capacitor. The preset voltage is a threshold voltage of a current drive transistor that provides current to the OLED. During the write data time interval, data in the form of a data voltage is added to the preset voltage on the storage capacitor. During the expose time interval, the current provided by the current drive transistor is dependent only on the data voltage on the storage capacitor, and it is independent of threshold voltage of the current drive transistor.

Figure 1:
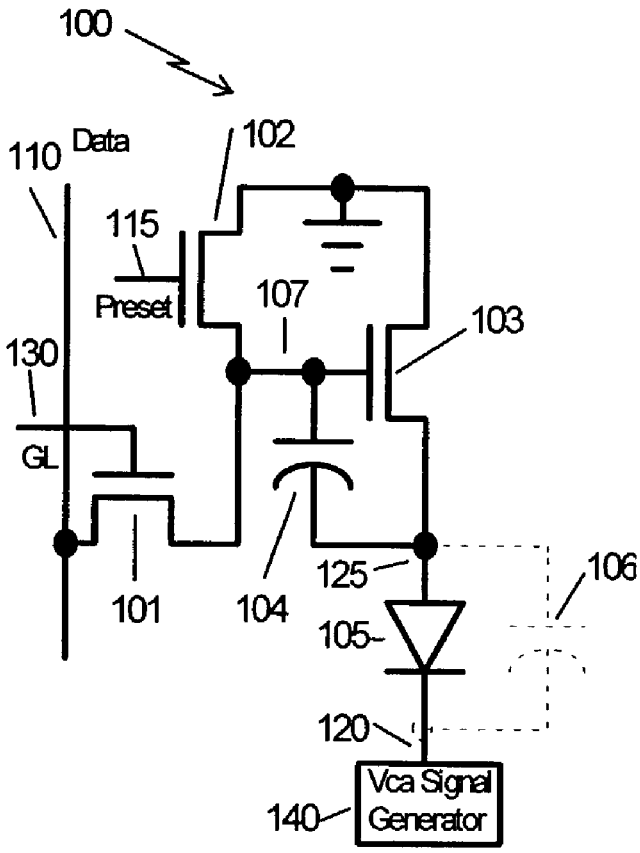
FIG. 1 is a schematic diagram of a voltage data current drive AMOLED pixel circuit in accordance with the present invention.

FIG. 1 is a schematic diagram of an embodiment of circuit 100 for driving an OLED 105 in accordance with the present invention. Circuit 100 employs a method that includes providing a current to the anode of OLED 105, and applying a variable voltage signal to the cathode of OLED 105 to facilitate control of the current. Such facilitation of current control includes applying a voltage to the cathode of OLED 105 to turn off OLED 105, applying a voltage to the cathode of OLED 105 to set a drive current for OLED 105, and applying a voltage to the cathode of OLED 105 to allow luminance of OLED 105.

Circuit 100 includes NMOS transistors 101, 102 and 103, and a storage capacitor 104, which operate collectively as a current source for providing a current to the anode of OLED 105. Circuit 100 has a data or column line 110 into which a data signal is input, a preset input 115 for a preset signal, and a gate (GL) 130 input for a gate line signal. Circuit 100 also includes a generator 140 for providing a variable voltage signal, i.e., cathode voltage (Vca) 120, to the cathode of OLED 105 to facilitate control of the drive current.

Cathode voltage (Vca) 120 may also be regarded as a multilevel voltage signal. That is, generator 140 can set cathode voltage (Vca) 120 to any one of a plurality of discrete voltage levels.

NMOS transistor 101 functions as a data voltage sampling transistor. When NMOS transistor 101 is on it provides a path for data in the form of a voltage from data line 110 to node 107.

NMOS transistor 102 functions as a data voltage reference-switching transistor. The source of NMOS transistor 102 is connected to node 107. When NMOS transistor 102 is on, it provides a path for a voltage from its drain to its source. In the embodiment shown in FIG. 1, the data voltage reference is circuit ground.

NMOS transistor 103 functions as an OLED current drive transistor. NMOS transistor 103 converts the voltage on storage capacitor 104 to a drive current for OLED 105.

Storage capacitor 104 is large (~500 nF) compared to a parasitic capacitance of NMOS transistors 101, 102 and 103 (~50 nF), but small when compared to a capacitance (~10 pF) of OLED 105. The capacitance of OLED 105 is represented by an OLED capacitance 106 drawn in dashed lines.

Although storage capacitor 104 is represented as a discrete component, it may be implemented as a capacitance characteristic of an element of circuit 100 that is not necessarily a discrete capacitor. For example, storage capacitor 104 may be implemented as a gate to source capacitance of NMOS transistor 103, or as a capacitance formed by an overlap of circuit nodes, e.g., circuit nodes 107 and 125.

Circuit 100 is one of a plurality of such circuits configured in a pixel array to provide an image on a display. Preset input 115 may be common to all pixels in the array. Cathode voltage (Vca) 120 may also be common to all pixel circuits in the array.

Figure 2:
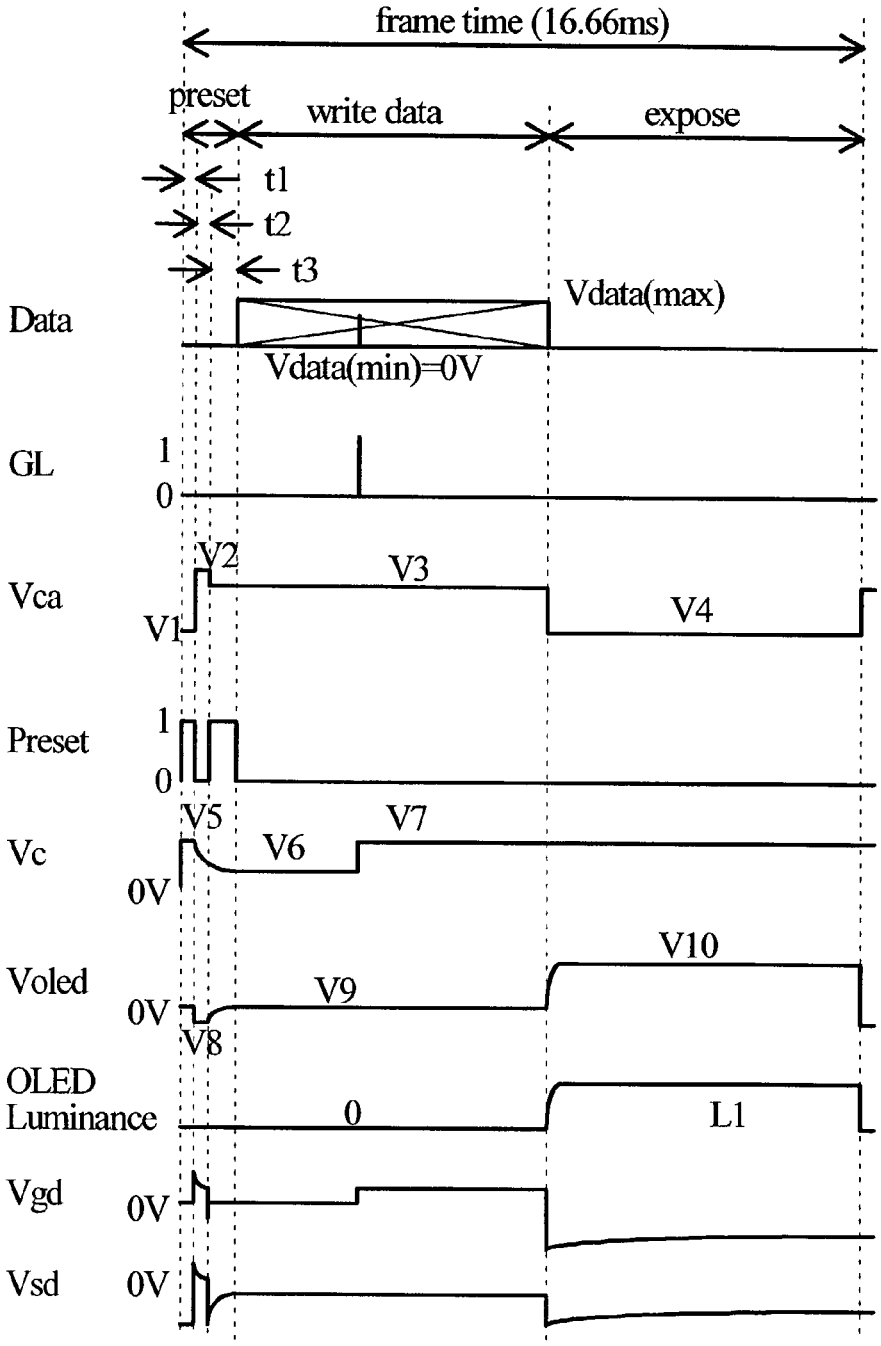
FIG. 2 is a timing diagram for the pixel circuit of FIG. 1.

FIG. 2 is a timing diagram for the pixel circuit of FIG. 1. Images on a display are typically updated sixty times a second. A time period from one image update to a next is called a frame time. In FIG. 2, the frame time is shown as 16.66 milliseconds. The frame time is broken up into 3 time periods, namely a preset time period, a write data time period and an expose time period. The preset time period is composed of three smaller time periods, namely t1, t2 and t3.

Presetting is a drive technique that establishes a preset voltage, across a storage capacitor, for an OLED current drive transistor while the OLED is off. The preset voltage level is controlled to be the same as a threshold voltage level of the current drive transistor. An OLED is off when the OLED's anode to cathode voltage is the voltage for onset of luminance or exponential current conduction. The onset voltage is typically 2 V. When the OLED is off, the OLED's capacitance dominates the OLED's impedance. The storage capacitor is connected across gate and source terminals of the OLED current drive transistor. As a threshold voltage is established across the storage capacitor, the positive terminal of the storage capacitor is referenced to ground. When writing a positive data voltage onto the positive terminal of the storage capacitor, the OLED capacitance maintains the negative terminal voltage of the storage capacitor. Cathode voltage of the OLED is subsequently changed to allow the OLED to emit light in accordance with the stored data voltage. An OLED drive current from the OLED current drive transistor is proportional to $Vdata^2$ where Vdata is a written positive data voltage.

Referring again to FIG. 1, a preset voltage is applied to storage capacitor 104 during a preset time period. The preset voltage is a threshold voltage of NMOS transistor 103. During a write time period, a data voltage is added to the preset voltage on storage capacitor 104. During an expose time period, a current through OLED 105, which is also the current through NMOS transistor 103, is proportional to $(Vdata)^2$, where Vdata is the data voltage stored on storage capacitor 104. During the expose time period, NMOS transistor 103 operates in saturation. The current through NMOS transistor 103 is $\sim(Vgs-Vt)^2$ where Vgs is the gate to source voltage of NMOS transistor 103 and Vt is a threshold voltage of NMOS transistor 103. The data voltage is written onto circuit node 107, i.e., the positive voltage terminal of storage capacitor 104. OLED capacitance 106 maintains the voltage at a circuit node 125, i.e., at the anode of OLED 105, which is also the negative terminal of storage capacitor 104, while the data voltage is written. Thus, by maintaining the voltage at circuit node 125, OLED capacitance 106 allows the data voltage to be added to the preset voltage during the write data time interval.

With amorphous silicon thin film transistors, a threshold voltage of NMOS transistor 103 may initially be ~2.5V. However, after being electrically stressed, the threshold voltage of NMOS transistor 103 may increase to ~10V. Circuit 100 can accommodate such a change in threshold voltage.

The cathode of OLED 105 is connected to generator 140 and its anode is connected to circuit node 125. OLED layers are deposited over the entire array of pixels, where each pixel has an anode contact. The OLED cathode is formed by depositing a conducting metal, often transparent, such as indium tin oxide, over the OLED layers. An electrical connection is made to a common cathode outside the array.

The presetting of storage capacitor 104 between circuit nodes 107 and 125 is achieved by operations of preset input 115 and generator 140, which sets cathode voltage (Vca) 120 through a sequence of voltage levels.

Referring to FIG. 2, the threshold voltage of NMOS transistor 103 is preset on storage capacitor 104 during the preset time period. Just after applying power to pixel circuit 100, the voltage across storage capacitor 104 and OLED 105 may be 0V. Recall that the preset time period is composed of time periods t1, t2 and t3, and that cathode voltage (Vca) 120 is a multilevel voltage signal.

Time period t1 occurs just after applying power to pixel circuit 100. Time period t1 occurs at the beginning of a first occurrence of a frame time, but it is not required for subsequent frames. In time period t1, preset input 115 is set high (i.e., to 1) turning on NMOS transistor 102 while generator 140 sets cathode voltage (Vca) 120 to V1. V1 is a voltage more negative than −1.05*Vt103(max), where Vt103(max) is a maximum end of life threshold voltage of NMOS 103. Since OLED capacitance 106 is ~20× larger than the capacitance of storage capacitor 104, a voltage V5 is developed across storage capacitor 104. V5 is ~Vt103 (max).

In time period t2, preset input 115 is set low (i.e., to 0) turning off NMOS transistor 102, and generator 140 sets cathode voltage (Vca) 120 to V2. OLED 105 is thus turned off, and its impedance appears as a capacitance. V2 is a voltage greater than Vt103(max)−Vt103(min)−Voled(onset), where Vt103(min) is the minimum threshold voltage for NMOS transistor 103 and where Voled(onset) is the OLED voltage for onset of light emission and exponential increase in current. The gate voltage of NMOS transistor 103 with respect to ground is high which turns NMOS transistor 103 on. After a period of time, the voltage of circuit node 125 is at ground, putting a voltage V8 across OLED 105. V8 is a voltage less than or more negative than +Vt103(min)−Vt103(max)+Voled(onset).

In time period t3, preset input 115 is set high while generator 140 sets cathode voltage (Vca) 120 to V3. V3, in cooperation with the preset voltage, establishes a voltage on storage capacitor 104 that is a threshold voltage of NMOS transistor 103. V3 is a voltage more positive than −Vt103 (min)−Voled(onset). NMOS transistor 103 discharges storage capacitor 104 and OLED capacitance 106 until the voltage across storage capacitor 104 is V6, which is the threshold voltage of NMOS transistor 103, i.e., a voltage between Vt103(min) and Vt103(max). The voltage across OLED 105 is less than V9, or V6−V3, or Voled(onset)+Vt103(min)−Vt103. At the end of time period t3, preset input 115 is set low turning off NMOS transistor 102.

At the beginning of the write data time period, circuit node 107 is 0V. Cathode voltage (Vca) of V3 enables the addition of the data voltage to storage capacitor 104. Because OLED capacitance 106 is substantially greater than storage capacitor 104, the voltage at circuit node 125 is maintained by OLED capacitance 106. Thus OLED capacitance 106 facilitates the storing of the preset voltage and the data voltage on storage capacitor 104. Data voltage from data line 110 is written to circuit 100 when gate line 130 is brought high. Data line 110 voltage is in a range between Vdata(min) and Vdata(max). For example, Vdata(min) may be 0V and Vdata(max) may be 10V. Since OLED capacitance 106 is not infinitely large, the data voltage across storage capacitor 104 will be decreased by ~5%. The voltage across storage capacitor 104 is V7 or 0.95*Vdata−Vt103. The voltage of OLED capacitance 106 increases slightly by 0.05*Vdata.

At the beginning of the expose time period, generator 140 sets cathode voltage (Vca) 120 to V4. V4 allows OLED 105 to illuminate as a function of the data voltage that was added onto storage capacitor 104. V4 is a voltage more negative than −Vt103(max)−Voled(max), where Voled(max) is maximum voltage across OLED 105 when producing maximum luminance. NMOS transistor 103 operates in its saturation current regime, Vds>Vgs−Vt. The current flowing through NMOS transistor 103 and OLED 105 will be proportional to $(0.95*Vdata+Vt-Vt)^2$ or proportional to $(Vdata)^2$. Thus, a data voltage to current transfer function is threshold voltage independent. The voltage across OLED 105 is V10. V10 is equal to or greater than Voled(onset) and depends upon current through NMOS transistor 103. The luminance of OLED 103 is L1. L1 is proportional to current through NMOS transistor 103.

Figure 3:
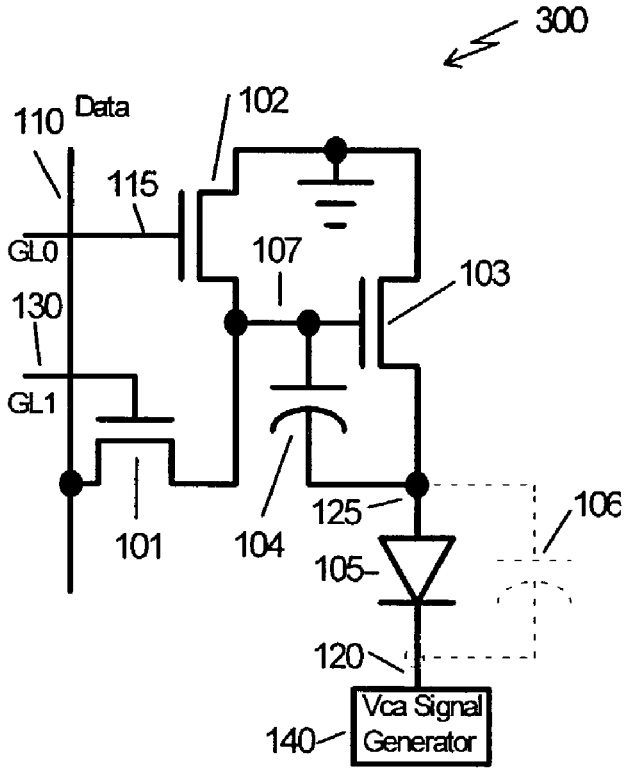
FIG. 3 is a schematic diagram of a voltage data current drive AMOLED pixel circuit using the previous gate or row line for presetting.

FIG. 3 is a schematic diagram of another embodiment of a pixel circuit in accordance with the present invention. FIG. 3 shows a circuit 300, i.e., a voltage data current drive AMOLED pixel circuit, that is similar to circuit 100 of FIG. 1 in that circuit 300 includes NMOS transistors 101, 102 and 103, storage capacitor 104, data line 110, OLED 105, generator 140 and circuit nodes 107 and 125, and is one of a plurality of such circuits configured in a pixel array to provide an image on a display.

In contrast with circuit 100, circuit 300 has two gateline inputs, namely GL0 and GL1. Presetting of circuit 300 is controlled by a signal that is applied to gateline GL0 from a previous row, adjacent pixel circuit (not shown). Thus, GL0 is also referred to as a previous gate line. GL0 controls the storage of the preset voltage onto storage capacitor 140. GL1 controls the writing of the data voltage onto storage capacitor 140 and is referred to as a present gate line. GL1 also serves as a previous gateline (GL0) for a next pixel circuit (not shown).

Figure 4:
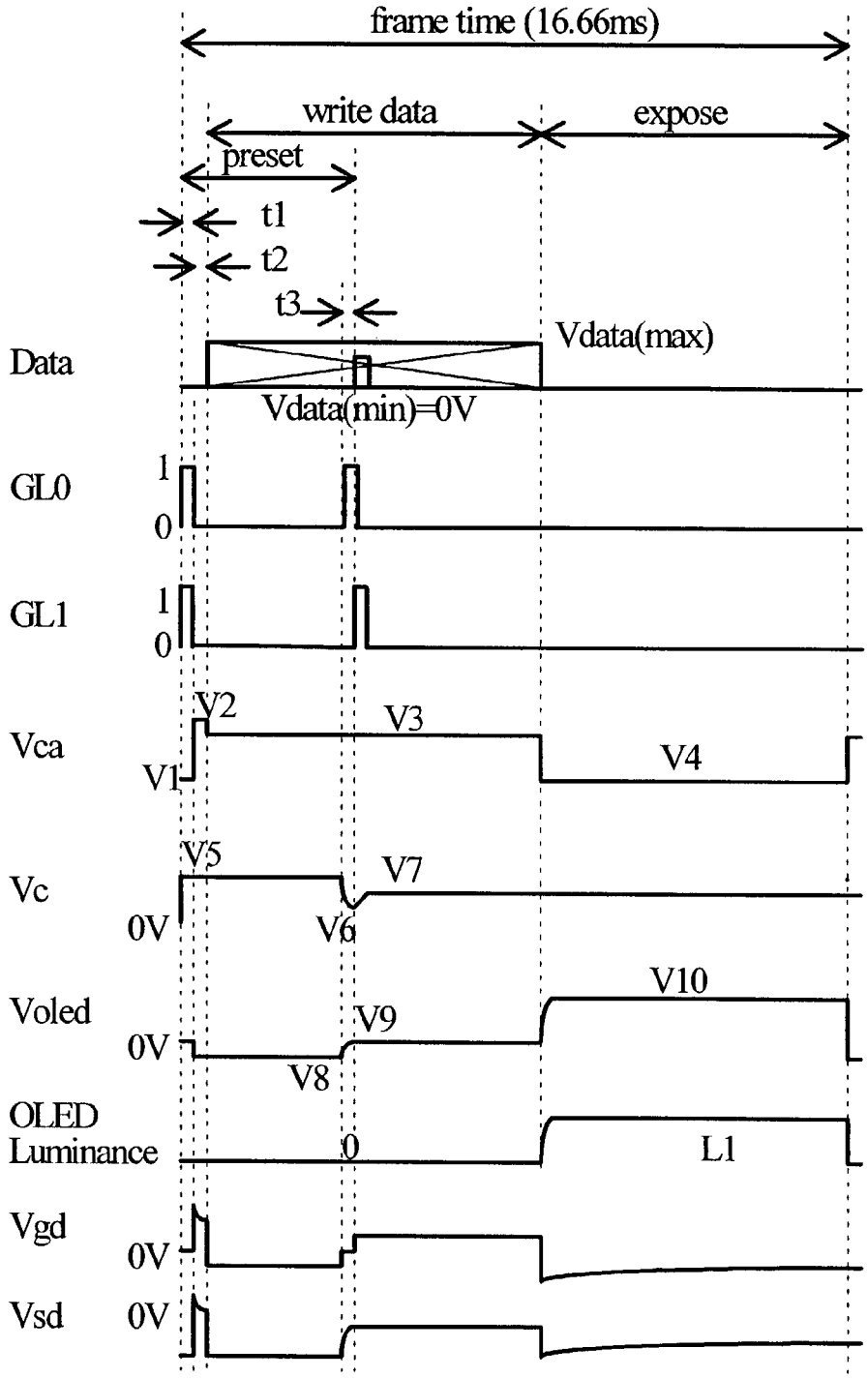
FIG. 4 is a timing diagram of the circuit of FIG. 3.

FIG. 4 is a timing diagram of the circuit of FIG. 3. A frame time is broken up into a preset time period, a write date time period and an expose time period, and the preset time period is composed of three smaller time periods, namely t1, t2 and t3.

In time period t1, an initial presetting of circuit 300 occurs before the array is addressed. Time period t1 occurs at the beginning of a first occurrence of a frame time, but it is not required for subsequent frames. The voltage of data line 110 is set to 0 V while gate lines GL0 and GL1 are brought high, and generator 140 sets cathode voltage (Vca) 120 to a voltage of V1. This results in a voltage V5 across storage capacitor 104 and ~0V across OLED 105.

In time period t2, gate lines GL0 and GL1 are low while generator 140 sets cathode voltage (Vca) 120 to V2. A voltage V8 is across OLED 105. At the end of time period t2, generator 140 switches cathode voltage (Vca) 120 to a voltage V3.

Time period t3 for an individual pixel occurs when the previous gate line GL0 is brought high. The completion of presetting of circuit 300 occurs during time period t3, just before data is to be written to circuit 300. NMOS transistor 102 is turned on connecting circuit node 107 to ground. The voltage across storage capacitor 104 goes to a preset voltage V6, i.e., the threshold voltage of NMOS 103.

In circuit 300, after GL0 goes low, and while GL1 is set high, data is written to circuit 300, that is the data voltage is added to the preset voltage on storage capacitor 104. NMOS transistor 102 is turned off and NMOS transistor 101 is turned on. The data voltage on data line 110 is written onto circuit node 107. Ideally, the resultant voltage across storage capacitor 104 will be equal to the sum of the preset voltage and the data voltage. However, in practice, the actual resultant voltage across storage capacitor 104 will be equal to the preset voltage plus 0.95 (data voltage). This difference between the ideal voltage and the actual voltage is due to the charging current through storage capacitor 104 into OLED capacitance 106 causing a slight increase of the voltage at circuit node 125.

During the expose time interval, generator 140 sets cathode voltage (Vca) 120 V4. NMOS transistor 103 operates in the saturation current regime, Vds>Vgs−Vt. Current flowing through NMOS transistor 103 into OLED 105 will be proportional to $(0.95*Vdata+Vt-Vt)^2$ or proportional to $(Vdata)^2$.

FIG. 4 shows waveforms for an individual pixel circuit 300 that is one of a plurality of such pixel circuits in a row of an array. Although the write data time period is shown as overlapping a portion of the preset time interval, that actual writing of the data voltage onto storage capacitor 104 for circuit 300 occurs just after time period t3 of the preset time period. The write data time period is shown as overlapping the preset time interval because other pixel circuits that are located nearer the top of the array will have data written to their respective storage capacitors before pixel circuit 300. Accordingly, the actual writing of the data voltage to pixel circuit 300 occurs somewhere in the middle of the write data interval, as shown in FIG. 4.

For example, assume that pixel circuit 300 is a pixel circuit in the $100^{th}$ row. Also assume that $GL0_n$ and $GL1_n$ are gate lines for an $n^{th}$ row. As such, the gate lines for pixel circuit 300 would be designated as $GL0_{100}$ and $GL1_{100}$. For a pixel circuit in the top row, $GL0_1$ (preset of the first pixel) pulses high in a time period t3 that is very near to the beginning of the preset time interval, and $GL1_1$ (write to the first pixel) pulses high very near the beginning of the write data interval. The write gate line of the first row pixel ($GL1_1$) also serves as the preset gate line for a second row pixel ($GL0_2$). As such, a second row pixel is preset by $GL0_2$ concurrently with the writing of data to a first row pixel by $GL1_1$. This sequence of presetting and writing propagates through the row of pixels such that the writing of data to the $99^{th}$ row pixel by $GL1_{99}$ is coincident with the presetting of the $100^{th}$ row pixel by $GL0_{100}$. Accordingly, the writing of data to the $100^{th}$ row pixel circuit by $GL1_{100}$ occurs well into the write data interval.

The first row pixel is in a row that is not preceded by any pixel circuit. As such, there is, theoretically, no previous gate line to serve as a $GL0_0$. Accordingly, $GL0_0$ receives a dummy pulse.

In both of circuits 100 and 300, an initial voltage is established across storage capacitor 104 at the beginning of a first occurrence of a frame time. For example, with reference to FIG. 2, in time interval t1, the preset voltage is set high, thus establishing a voltage V5 across storage capacitor 104. Similarly, referring to FIG. 4, in time interval t1, GL0 is set high to establish voltage V5 across storage capacitor 104. Note also in FIG. 4, that during time interval t1, GL1 is set high, because it serves as a GL0 for a pixel circuit in a next row. For subsequent frames, time interval t1 is not required because the voltage across storage capacitor 104 is assured to be equal to or greater than Vt due to a previous preset voltage, and NMOS transistors 101 and 102 drain to source leakage currents.

A polarity reversal of voltage on the source to drain and gate to drain terminals of the NMOS transistor 103 serves to remove trapped charge from theses regions, thereby minimizing the effects of electrical stress on NMOS transistor 103. In FIG. 2 and FIG. 4, the voltage polarity changes of the gate to drain terminal and source to drain terminals of NMOS transistor 103 are shown as Vsd and Vgd, respectively. During the t1 and t3 time intervals, Vgd is at 0V. Vgd is positive during the t2 time interval and during the write time interval after data has been written. Vgd is negative during the expose interval. At the beginning of the t2 time interval, Vsd voltage is positive. Vsd is at 0V at the end of the t2 time interval. Vsd is a negative voltage during all other time intervals.

Circuits 100 and 300 are current sources for driving an anode of OLED 105, where OLED 105 is configured with a common cathode. That is, the common cathode is the connection to Vca signal generator 140, which is also connected to the cathodes of all OLEDs in the display.

Circuits 100 and 300 can be implemented with PMOS transistors where the cathode of OLED 105 is driven and the anode of OLED 105 is common. In such a configuration, the circuit forms and voltages are complimentary to those of FIGS. 1–4.

The pixel circuits of the present invention offers several advantages that are worth noting:

(1) The present invention substantially reduces threshold voltage variations and the undesirable effects of threshold voltage variations.

(2) The present invention uses a small number of components thus allowing for small pixel sizes, high resolution and low power dissipation. For example, in the embodiments of circuits 100 and 300, only three transistors and one circuit capacitor are needed, and the transistors can be configured with amorphous silicon NMOS.

(3) In the present invention, commercially available voltage drivers can be used to address the pixel with threshold independent OLED drive current transformation with an amorphous silicon active matrix array.

It should be understood that various alternatives and modifications of the present invention could be devised by those skilled in the art. The present invention is intended to embrace all such alternatives, modifications and variances that fall within the scope of the appended claims.

What is claimed is:

1. A circuit for driving an organic light emitting diode (OLED), comprising:

a current drive transistor for providing current to a first terminal of said OLED;

a capacitor for storing a preset voltage and a data voltage to control said current drive transistor, wherein said capacitor is connected to said first terminal;

a data transistor for adding said data voltage onto said capacitor; and a generator for providing a variable voltage signal to a second terminal of said OLED to facilitate said control of said current drive transistor, wherein said variable voltage signal comprises a voltage level for facilitating said storing of said preset voltage.

2. The circuit of claim 1, wherein said current, when flowing, is substantially independent of a threshold voltage of said current drive transistor.

3. The circuit of claim 1, wherein said preset voltage and said data voltage are relative to a data reference voltage.

4. The circuit of claim 1, wherein said variable voltage signal further comprises a voltage level that facilitates said storing of said data voltage.

5. The circuit of claim 1, wherein said OLED has a capacitance that facilitates said storing of said preset voltage and said data voltage.

6. The circuit of claim 1, wherein said variable voltage signal comprises a voltage level for turning off said OLED.

7. The circuit of claim 1, wherein said variable voltage signal comprises a voltage level for facilitating said storing of said data voltage.

8. The circuit of claim 1, wherein said variable voltage signal comprises a voltage level for allowing luminance of said OLED.

9. The circuit of claim 1, wherein said variable voltage signal comprises a voltage level for reversing a voltage polarity across said OLED.

10. The circuit of claim 1, wherein said variable voltage signal comprises a voltage level for reversing a source to drain voltage polarity of said current drive transistor.

11. The circuit of claim 1, wherein said variable voltage signal comprises a voltage level for reversing a gate to drain voltage polarity of said current drive transistor.

12. The circuit of claim 1, wherein said current drive transistor and said data transistor are amorphous silicon transistors.

13. A circuit for driving an organic light emitting diode (OLED), comprising:

a current drive transistor for providing current to a first terminal of said OLED;

a capacitor for storing a preset voltage and a data voltage to control said current drive transistor, wherein said capacitor is connected to said first terminal;

a data transistor for adding said data voltage onto said capacitor;

a generator for providing a variable voltage signal to a second terminal of said OLED to facilitate said control of said current drive transistor; and a data reference voltage transistor for establishing a data reference voltage, wherein said preset voltage and said data voltage are referenced to said data reference voltage.

14. The circuit of claim 13, wherein a preset signal controls operation of said data reference voltage transistor.

15. The circuit of claim 14, wherein said circuit is a member of a plurality of circuits in an array of rows and columns, and wherein said preset signal is provided to said plurality of circuits.

16. The circuit of claim 14, wherein said circuit is in a row of an array that contains a plurality of such circuits, and wherein said preset signal is provided from a gate line signal that is used by another row in said array.

* * * * *